United States Patent [19]

Baum et al.

[11] 4,075,246

[45] Feb. 21, 1978

[54] 1,3-BIS(2,2,2-FLUORODINITROETHOXY)-2,2-BIS(DIFLUORAMINO) PROPANE

[75] Inventors: Kurt Baum, Pasadena; Vytautas Grakauskas, Arcadia, both of Calif.

[73] Assignee: The United States of America as represented by the Secretary of the Air Force, Washington, D.C.

[21] Appl. No.: 737,116

[22] Filed: Oct. 29, 1976

[51] Int. Cl.[2] ..... C07C 93/04; C06B 25/00

[52] U.S. Cl. ..... 260/584 C; 149/88

[58] Field of Search ..... 260/584 B, 584 C, 584 R, 260/583 NH, 644; 149/19.3, 88

[56] References Cited

U.S. PATENT DOCUMENTS

| | | | |
|---|---|---|---|
| 3,436,419 | 4/1969 | Rhodes | 260/583 NH |
| 3,624,155 | 11/1971 | Dinwoodie et al. | 260/563 R |
| 3,714,260 | 1/1973 | Coon et al. | 260/583 NH |
| 3,968,160 | 7/1976 | Reed | 260/584 R |

OTHER PUBLICATIONS

Baum, "Jacs", vol. 90(25), pp. 7083–7089, (1968).

Grakauskas, "J. Org. Chem.", vol. 38(17), pp. 2999–3004, (1973).

*Primary Examiner*—Daniel E. Wyman

*Assistant Examiner*—John J. Doll

*Attorney, Agent, or Firm*—Joseph E. Rusz; William J. O'Brien

[57] ABSTRACT

A method for producing 1,3-bis (2,2,2-fluorodinitroethoxy) -2,2-bis (difluoramino) propane by effecting a reaction between difluoramine and 1,3-bis(2,2,2-fluorodinitroethoxy)-2-propanone in a strong acid medium to produce a new high energy plasticizer for advanced energetic propellants.

1 Claim, No Drawings

1,3-BIS(2,2,2-FLUORODINITROETHOXY)-2,2-BIS(-DIFLUORAMINO) PROPANE

STATEMENT OF GOVERNMENT INTEREST

The invention described herein may be manufactured and used by or for the Government for governmental purposes without the payment of any royalty thereon.

BACKGROUND OF THE INVENTION

This invention relates to 1,3-bis(2,2,2-fluorodinitroethoxy)-2,2-bis(difluoramino)propane and to a process for its preparation. More particularly, this invention concerns itself with a process for effecting the difluoramination of 1,3-bis(2,2,2-fluorodinitroethoxy)-2-propanone and to the product produced thereby.

Compounds containing both fluorodinitro and gemminal bis(difluoramino) functional groups are finding application in formulations of advanced energetic propellants. They have been found to be especially useful as high energy plasticizers for propellant and explosive formulations.

The basic reactions for producing these high energy functional groups are the direct fluorination of dinitrocompounds or a reaction between a ketone and difluoramine.

Because the ether function usually leads to good low temperature properties and chemical stability of energetic molecules, it was desirable to synthesize an ether containing the maximum number of these energetic groups. However, the reaction of ketones with difluoramine to give the corresponding gemminal bis(difluoramino) derivative is extremely difficult since it is sensitive to the electronic properties of substituents. Substituents with ether functions are difficult to react in this way because the ether oxygen is protonated by strong acid and the resulting positive charge inhibits protonation of the carbonyl group, which is necessary for difluoramination.

In attempting to synthesize 1,3-bis(2,2,2-fluorodinitroethoxy)-2,2-bis(difluoramino)propane, a material particularly useful as a plasticizer for propellant compositions, it has been found that the problems encountered heretofore can be abrogated by the process of this invention which accomplishes difluoramination by effecting a reaction between difluoramine and 1,3-bis(-fluorodinitroethoxy)-2-propanone in a strong acid medium. The propanone starting material for the reaction referred to above is initially prepared by the addition of fluorodinitroethanol to epichlorohydrin followed by oxidation. The resulting ketone is then reacted with difluoramine and oleum to give a high yield of 1,3-bis(2,2,2-fluorodinitroethoxy)-2,2-bis(difluoramino)propane, hereinafter referred to as SYEP.

SUMMARY OF THE INVENTION

In accordance with this invention, it has been found that SYEP, a material especially useful as a plasticizer component for rocket propellant, can be synthesized by reacting 1,3-bis(fluorodinitroethoxy)-2-propanone with difluoramine in a strong acid medium. The 1,3-bis(-fluorodinitroethoxy)-2 propanone starting material can be synthesized in a two-step process by reacting epichlorohydrin with two moles of fluorodinitroethanol in aqueous alkali to give 1,3-bis(fluorodinitroethoxy)isopropanol, followed by oxidation of the resulting alcohol. A process more fully described by Grakauskas, J. Org. Chem. 38, 2999 (1973).

The propanone reactant in combination with difluoramine and oleum gives a high yield of SYEP. The preferred temperature for this reaction is 0° to 25° C. The lowest temperature that can be used is the freezing point of the oleum mixture (about 0° to −10°), and at temperatures over 35° decomposition is likely to result. An inert solvent such as methylene chloride may be added for convenience in adding the ketone as well as to reduce the explosive sensitivity of difluoramine. The product is useful as a high energy plasticizer for propellant and explosives formulations and possesses a low freezing point and low volatility.

Accordingly, the primary object of this invention is a method for synthesizing 1,3-bis(2,2,2-fluorodinitroethoxy)-2,2-bis(difluoramino)propane.

Another object of this invention is to provide a method for effecting the difluoramination of 1,3-bis(-fluorodinitroethoxy)propanone.

The above and still other objects and advantages of the present invention will become more readily apparent upon consideration of the following detailed description thereof.

DETAILED DESCRIPTION OF THE PREFERRED EMBODIMENT

The present invention encompasses a process for synthesizing 1,3-bis(2,2,2-fluorodinitroethoxy)-2,2-bis(-difluoramino)propane, also referred to as SYEP. This is accomplished by reacting difluoramine with 1,3-bis(-fluorodinitroethoxy)-2-propanone in a strong acid medium. In this reaction, the difluoramine can be generated from aqueous difluorourea in accordance with the method of Grakauskas and Baum, J. Am. Chem. Soc., 92, 2096 (1970). The difluorourea is passed into 30% fuming sulfuric acid to give difluoraminosulfamic acid. A methylene chloride solution of 1,3-bis(fluorodinitroethoxy)-2-propanone is then added to the difluoraminosulfamic-sulfuric acid mixture and the reaction is allowed to proceed for a few hours at ambient temperature. The organic phase containing SYEP is separated, washed and dried to give a practically quantitative yield of the compound.

This process can be exemplified by referring to the following equation.

$$NH_2CONF_2 + H_2O \xrightarrow[\Delta]{H_2SO_4} HNF_2 \xrightarrow{H_2SO_4/SO_3} NF_2SO_3H \quad (1)$$

$$FC(NO_2)_2CH_2OCH_2COCH_2OCH_2C(NO_2)_2F + 2NF_2SO_3H \xrightarrow[CH_2Cl_2]{H_2SO_4} FC(NO_2)_2CH_2OCH_2C(NF_2)_2CH_2OCH_2C(NO_2)_2F$$

The compound, a colorless liquid somewhat less viscous than bis-fluorodinitroethyl formal hereinafter referred to as FEFO, $d = 1.65$, was characterized by elemental analysis and by proton and fluorine nmr spectra.

The following additional physical properties of SYEP were also found. Differential thermal analysis: exotherm starts at 157°, maximum at 245°. Impact sensitivity: drop hammer (2.5 kg), ⅛" gap (without sandpaper), 30 cm. Freezing point −2.5°. Boiling point ca 120° at $10^{-5}$ Torr (slight decomposition). Thermal stability: two 0.25 g samples heated at 120° for 22 hours liberated 1.60 and 1.91 cc of gas, respectively.

At the beginning of this work some problems were encountered with the purity of SYEP which soon were traced to the impurities present in the starting material, 1,3-bis(fluorodinitroethoxy)propanone. When high purity ketone became available, difluoramination reactions reactions proceeded quantitatively and gave SYEP of excellent purity (98%+).

The SYEP was analyzed by nmr. Both, the proton (a doublet and a singlet) and fluorine (a triplet and a singlet) spectra of SYEP are very simple and concentrated solutions of the material were used in order to suppress the background noise, with impurities present in 1-2% concentration being detectable. Nmr analyses are simple to perform and provide quick information about the purity of SYEP.

1,3-bis(fluorodinitroethoxy)isopropanol, the precursor of 1,3-bis(fluorodinitroethoxy)propanone through oxidation, is synthesized from fluorodinitroethanol and epichlorohydrin in either one or two steps. In the one step route two moles of fluorodinitroethanol are reacted with one mole of epichlorohydrin in aqueous alkaline formaldehyde solution at ambient temperature. This reaction is very slow and several days are needed for its completion. It proceeds by a nucleophilic attack by fluorodinitroethoxy ion on the epoxide to give the corresponding halohydrin intermediate, 1-(fluorodinitroethoxy)-3-chloroisopropanol which is cyclized to fluorodinitroethyl glycidyl ether by the base. The glycidyl ether then reacts with fluorodinitroethanol to give 1,3-bis(fluorodinitroethoxy)isopropanol.

In the two step reaction scheme, fluorodinitroethyl glycidyl ether prepared separately be several available routes, including the fluorodinitroethyl-epichlorohydrin reaction, is reacted with a molar amount of fluorodinitroethanol in the presence of sodium hydroxide, again in aqueous formaldehyde. Several days are needed to complete this reaction.

The best reaction conditions for the synthesis of 1,3-bis(fluorodinitroethoxy)isopropanol involve reacting two moles of fluorodinitroethanol with one mole of epichlorohydrin in ca 500 ml of 37% aqueous formaldehyde and two moles of sodium hydroxide (as 50% aqueous solution) at ambient temperature for a period of two to three days with efficient stirring. A small amount of phase-transfer catalyst, methyl tricaprylyl ammonium chloride, may be employed. For the first several hours this reaction is mildly exothermic and some cooling may be required.

The weight of crude material obtained in the above reaction usually amounts to 90% of the weight of fluorodinitroethanol employed. However, 1,3-bis(-fluorodinitroethoxy)isopropanol is is a minor component in this mixture. The crude 1,3-bis(fluorodinitroethoxy)isopropanol can then be oxidized to 1,3-bis(-fluorodinitroethoxy)propanone. However, a number of problems arose in these oxidations using highly impure material, and it became apparent that some type of prepurification of the alcohol was needed. A number of simple potential techniques such as crystallization, washing, attempting to prepare crystallizable derivatives, and others were explored, but the most practical were distillation and liquid-liquid extraction.

The Jones reagent, chromium trioxide in sulfuric acid and acetone, has been found to be best for the oxidation of 1,3-bis(fluorodinitroethoxy)isopropanol to 1,3-bis(-fluorodinitroethoxy) 5°-25° C. The yield of this oxidation has been found to be 95-100% when pure alcohol is used. One drawback of this oxidation is the flammability hazard of the solvent. Other oxidizing agents such as aqueous dichromate or glacial acetic acid solution of chromium trioxide, may be used but are less satisfactory.

In order to more fully understand the invention, reference is now made to the following detailed examples which illustrate specific embodiments of the invention.

EXAMPLE I

Difluoramine (9 g) was generated from aqueous difluorourea under nitrogen and was condensed onto 24 ml of 20% sulfuric acid by means of a 76° condenser. After 30 min, a solution of 12 g (0.033 mol) of 1,3-bis(-fluorodinitroethoxy)-2-propanone in 50 ml of methylene chloride was added over a 30 min period. The mixture was stirred for 2 hours. The methylene chloride layer was separated, stirred with 25 ml of water for 2 hours, dried over sodium sulfate and filtered through silica gel. Removal of the solvent gave 11.7 g (79% yield) of 1,3-bis(2,2,2-fluorodinitroethoxy)-2,2-bis(difluoramino)propane: proton nmr ($CDCl_3$) δ4.59 (d, 4 H, J = 16.6 Hz, $FCCH_2$), δ4.17 (s, broadened, 4H, $O—CH_2—C$); fluorine nmr ($CDCl_3$) $\phi$ −27.92 (s, 4 F, $NF_2$) and +110 (broad, s, 2 F, $FC(NO_2)_2$).

Anal. Calcd for $C_7H_8N_6F_6O_{10}$: C, 18.67; H, 1.79; N, 18.67. Found: C, 18.44; H, 1.58; N, 17.91.

EXAMPLE II

Difluoramine (130 g) was condensed under nitrogen onto a mixture of 260 ml of 30% fuming sulfuric acid and 360 ml of methylene chloride by means of a −70° condenser. The mixture was stirred and kept at a temperature of 10° ± 5 by a thermostated reactor jacket for 1 hour. A solution of 181 g (0.5 mol) of 1,3-bis(-fluorodinitroethoxy)-2propanone in 725 ml of methylene chloride was then added dropwise, with stirring at 10° ± 5. The mixture was stirred for 1 hour at 25°, and the lower layer was separated and discarded. The methylene chloride solution was stirred with 1 liter of water for 2 hours. The solution was dried over sodium sulfate, and solvent was distilled off and continuously replaced with fresh solvent until the distillate did not react with KI- starch paper. Removal of solvent from an aliquot under high vacuum showed 224.3 g (99.7% yield) of product identical with that in Example I.

It should be understood by those skilled in the art to which the present invention pertains that while the process described herein illustrates a preferred embodiment of the invention, various modifications and alterations may be made without departing from the spirit thereof, and that all such modifications as fall within the scope of the appended claims are intended to be included herein.

What is claimed is:

1. 1,3-bis(2,2,2, -fluorodinitroethoxy)-2,2-bis(difluoramino)propane.

* * * * *